US006073663A

United States Patent [19]

Dewispelaere

[11] Patent Number: 6,073,663

[45] Date of Patent: Jun. 13, 2000

[54] SHED-FORMING DEVICE FOR TWO-POSITION OPEN SHED WEAVING MACHINES

[75] Inventor: Andre Dewispelaere, Kortrijk/Marke, Belgium

[73] Assignee: N.V. Michel Van de Wiele, Kortrijk/Marke, Belgium

[21] Appl. No.: 09/233,107

[22] Filed: Jan. 19, 1999

[30] Foreign Application Priority Data

Jan. 19, 1998 [BE] Belgium ..... 09800035

[51] Int. Cl.[7] ..... D03C 3/12; D03C 3/20

[52] U.S. Cl. ..... 139/455

[58] Field of Search ..... 139/455

[56] References Cited

U.S. PATENT DOCUMENTS

| | | | |
|---|---|---|---|
| 4,515,186 | 5/1985 | Durville et al. | 139/455 |
| 4,739,806 | 4/1988 | Palau et al. | 139/455 |
| 5,133,389 | 7/1992 | Griffith | 139/455 |
| 5,176,186 | 1/1993 | Bousfield et al. | 139/455 |
| 5,743,308 | 4/1998 | Bassi et al. . | |
| 5,839,481 | 11/1998 | Bassi et al. | 139/455 |

FOREIGN PATENT DOCUMENTS

| | | |
|---|---|---|
| 0 723 041 | 7/1996 | European Pat. Off. . |
| 0 779 384 | 6/1997 | European Pat. Off. . |

*Primary Examiner*—Andy Falik
*Attorney, Agent, or Firm*—James Creighton Wray; Meera P. Narasimhan

[57] ABSTRACT

A shed-forming device for individually controlling heddles for warp threads of a weaving device has hook elements connected to the heddles for the warp threads. Upward and downward moving knives are provided to which the hook elements can hook onto. The hook elements are provided with spring elements and actuators connected to the spring elements allow the hook elements to selectively hook or not hook onto the upward and downward moving knives. Each hook element also has at least three spring elements in the form of spring legs. At least two spring elements are made as double laminated springs. At least two of the spring legs are provided with hooks for working together with the moving knives. One or more actuators are provided which selectively influence the various spring elements. Retaining hooks are provided for at least a part of the spring elements in a position determined by an actuator.

11 Claims, 3 Drawing Sheets

FIG. 6
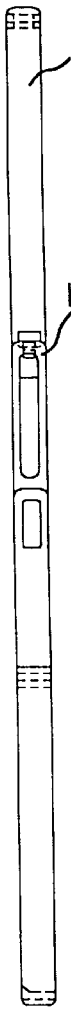
FIG. 8
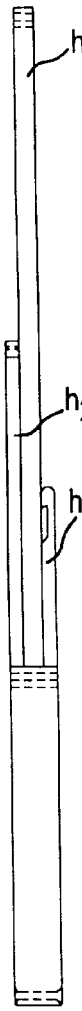
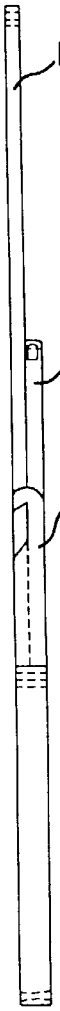
FIG. 7
FIG. 9
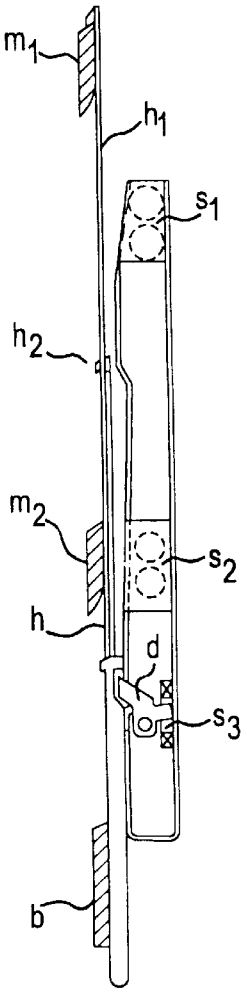
FIG. 10
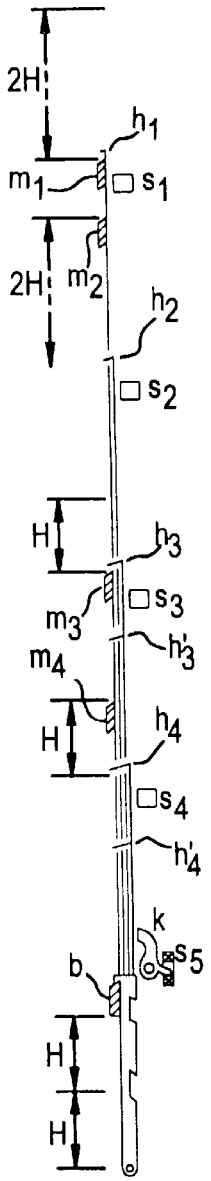

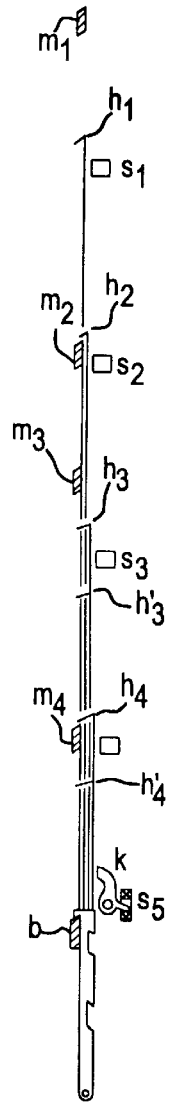
FIG. 11
FIG. 12
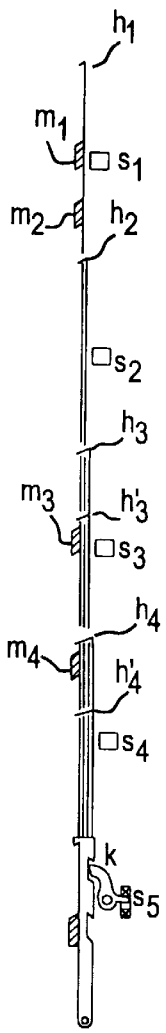
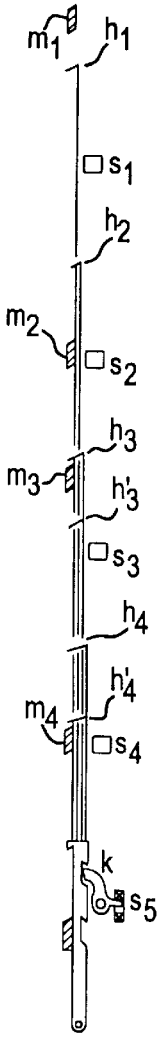
FIG. 13
FIG. 14
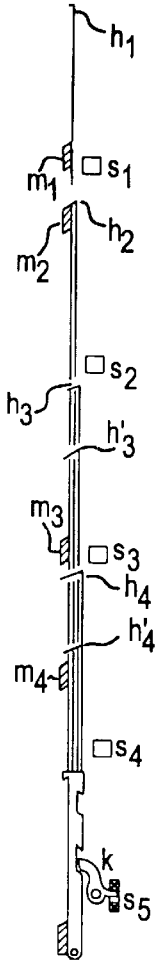
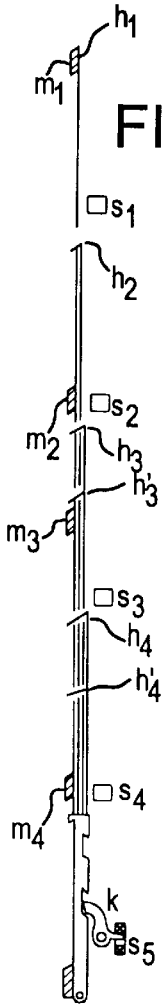
FIG. 15
FIG. 16
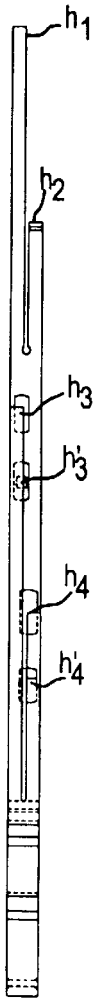

SHED-FORMING DEVICE FOR TWO-POSITION OPEN SHED WEAVING MACHINES

BACKGROUND OF THE INVENTION

The invention relates to a device for shed forming whereby the position of the heddles for the warp threads in a weaving machine are individually controlled according to the open-shed principle. In such a shed-forming device the heddles for the warp threads can occupy two positions: Bottom, i.e. below the weft insertion level, and Top, i.e. above the weft insertion level. It is called a two-position open shed when each position can be reached, or be maintained, on every pick.

From the British patent publication GB 2 047 755 a shed-forming device for a weaving machine is known whereby the arcades are suspended from a pulley element. Around the wheel of this pulley element a cord is passed of which each extremity is connected to a leaf-spring-shaped hook. Each leaf-spring-shaped hook is provided on the bottom part with a nose with which it can rest on a corresponding lifting knife. The knives are brought two by two in opposite phase in an upward and downward movement. The leaf spring hooks are provided on top with a hook with which in a top position they can hook onto a fixed knife through the influence of an electromagnet which is placed between two leaf springs that work together. The nose of the bottom part of the leaf-spring-shaped hooks however always remains in the path of the ascending and descending lifting knives that work together. An unselected hook always remains on its corresponding lifting knife. The "bottom" positions for the leaf spring hooks are therefore formed by the moving lifting knives.

With this existing system the pulley device is a great disadvantage. At high weaving speed the reversing rollers of the pulley device have to rotate fast backward and forward. Heat develops through the friction which occurs in the bearing of the wheel and through slipping of the cord on the groove surface of the wheel. The cord must bendingly unwind onto the reversing roller at high frequency. This cord is subject to wear and tear and finally breaks. It also often occurs that through the dust in the weaving area the wheel will jam, through which the cord prematurely breaks through severe friction. After a time all pulley elements have to be preventively replaced when the number of pulley cord breakages becomes too great and because of this the weaving efficiency of the weaving installation will decline. The replacement of thousands of pulleys per weaving unit is time-consuming, requires specialized personnel and because of this causes an increase in running costs.

EP 0 711 856 describes an attempt at remedying these disadvantages by operating without any pulley element. This device however has the disadvantage that a preselection of the hooks must take place with the implementation of a small lift at the frequency of the weft insertion frequency. In other words the selectors and the grids on which these are mounted must perform an upward and downward movement during a weft insertion cycle. This leads to severe vibrations at high operating speed of e.g. 1,000 min. Another disadvantage is that the lifting knives must be provided with spring catch hooks which drag against the jacquard hooks. This develops heat and is the cause of considerable mechanical loss.

Another attempt according to EP 0 779 384 also has the intention of being able to operate without pulley element. The disadvantage of that technique is that a two-legged hook is required whereby the harness load in each case comes in the middle, through which the hooks are eccentrically loaded. In order to offset this eccentric loading a central guiding body has to be provided. This however causes extra friction through which this device also suffers high mechanical losses. Because of the fact that this solution rests on a two-legged hook this device takes up rather a lot of room in horizontal plane. The footprint is rather large.

Shed-forming devices are also utilized in three-position jacquard machines such as namely those employed with face-to-face double gripper weaving machines for weaving jacquard velvet and for weaving multiple pile warp thread carpets. With a double gripper weaving machine in each weft insertion cycle two wefts are simultaneously inserted. This means that the pile warp threads can occupy three positions:

Bottom: below both weft insertion means

Middle: between the two weft insertion means

Top: above both weft insertion means.

It is called a three-position open-shed jacquard machine when each position of the three positions can be reached or continue to be maintained on every pick or weft insertion cycle. Three-position open-shed jacquard machines are implemented by providing two hooks of a two-position open-shed jacquard machine with a pulley device. The importance of three-position open-shed jacquard machines for weaving jacquard velvet and multiple pile warp thread carpets is that pile weave corrections can be applied at the time of color transitions where this appears necessary in order to avoid mixed contours and double tufts on the pile side when using the two-shot weave.

From the French patent publication no. 1.225.173 a three-position jacquard machine is known with open shed for the middle and bottom position and non-open shed for the top position. This device makes use of two card-operated hooks which are connected to each other by a pulley cord, which runs around the top wheel of a pulley device, and a bottom pulley cord which is secured to a movable grid and is rerouted over the bottom wheel in order then to be connected to the harness cord(s) with the other extremity. With this device the bottom and middle position can be reached or maintained on every pick, the top position can only be reached on every second pick. The disadvantage of this device is the use of pulley cords. Through the repeated passing around and the friction of the cords on the wheels, the cords are subject to wear and tear through which they will break. A device also has to be provided in order to move the bottom pulley grid.

From the French patent publication no. 1.513.410 a three-position open-shed jacquard machine is known which makes use of two hooks of a two-position open-shed jacquard machine and one pulley element. The device makes use of two hooks: this means that for a specific number of cords with three positions, a double capacity in hooks has to be installed. The pulley cords are here again the weak element of the device. With the higher weaving speeds, which are customary at present, the pulley cords break prematurely.

From the French patent publication no. 2 466 541 a similar device is known, but with a movement reinforcement built into the pulley device. The disadvantage of this device is also here the use of twice the number of hooks and pulley cords, and the extra reversing roller which is necessary for the movement reinforcement.

From the European patent publication no. 0 399 930 a device is known which makes use of two complementary hooks, each with its own pulley and one reversing roller in order to achieve the three-position open shed. With this pulley device the pulley cords are passed around in two planes standing perpendicular to each other through which the pulley cords break through fatigue and wear and tear of the fibers in the pulley cords. Here two neighboring hooks are also necessary in order to obtain a three-position device.

These known devices all have the disadvantage that the pulley cords of the pulley device are subject to wear and tear and that the pulley cords will break, which makes premature replacement necessary. This problem becomes more serious with current weaving speeds.

This invention now has the purpose of providing a shed-forming device which prevents the deficiencies and disadvantages of the state-of-the-art, and which is suitable for being used on jacquard devices of different types, namely two-position open-shed jacquard machines and three-position open-shed jacquard machines.

SUMMARY OF THE INVENTION

For this purpose the shed-forming device according to the invention comprises hook elements which are connected to the heddles for the warp threads, and upward and downward moving knives to which the hook elements can hook onto, whereby the hook elements are provided with spring elements and whereby actuators are provided which can influence the spring elements in order to allow the hook elements selectively to hook or not hook onto the upward and downward moving knives. According to the invention each hook element is moreover provided with at least three spring elements in the form of spring legs, at least two spring elements are made as at least double laminated springs, at least two of the spring legs are provided with hooks, destined to work together with the moving knives, one or more actuators are provided which can selectively influence the various spring elements, and retaining hooks are provided for at least a part of the spring elements in a position influenced by an actuator.

According to one specific embodiment of the invention, destined for a two-position open-shed jacquard weaving device, each hook element of the shed-forming device is preferably provided with three spring legs of different lengths in the form of a triple spring element, whereby the two longer legs of a hook, destined to work together with two knives, are provided along one side of the hook element, moving in opposite phase, while each hook element comprises one actuator in order to influence at least one of the spring legs in a high position of the hook element and a second actuator for influencing one or more spring legs in a low position of the hook element, and whereby a retaining hook is provided on or nearby the second actuator which retaining hook retains the shortest of the spring legs in the position influenced by the actuator.

The problem in this embodiment is therefore namely solved by preferably providing a triple laminated hook with a long leg, and middle leg and a short leg. This hook is provided on the bottom with a projection with which the hook can rest on a fixed bottom grid when the hook is not lifted. Above this fixed grid are two knife systems which are movable upward and downward in opposite phase in order to lift the hooks. These knife systems move in the same plane alternately toward and away from each other. The hooks are made of a magnetic material such as e.g. steel. Two electromagnetic coils are provided in order to act on the hooks and to make these bend through which they cannot be engaged by the moving knives. The bottom electromagnetic coil is also provided with a projecting hook in order to be able to hold up the hook with the short leg in its top position.

According to a further characteristic of the invention the triple spring element can therefore be made in the form of a triple laminated spring element, but also in the form of a triple split spring element, or of a double laminated, partially split spring element, or similar.

According to another specific embodiment of the invention, destined for a three-position open-shed jacquard weaving device, each hook element is preferably provided with four spring legs of different lengths in the form of a double laminated, double spring element, whereby each of the two longer legs is provided with one hook destined to work together with two top knives, along one side of the hook element, moving in opposite phase, and whereby each of the two shorter legs is provided with two hooks destined to work together at different heights with two bottom knives, along one side of the hook element, moving in opposite phase, while each hook element comprises five actuators for influencing the various spring legs in different positions of the hook element.

According to a further characteristic of the invention one of the actuators can moreover comprise a locking mechanism in order to be able to retain the hook element at selected heights when one or more of the other actuators so influences the spring legs that the hooks on the corresponding spring legs do not hook onto the upward and downward moving knives.

The problems in this embodiment of the invention are therefore solved by no longer using a pulley device with pulley cords for implementing the three positions. In order to implement the three positions firstly four knife systems are provided which move in one and the same vertical plane. The knives perform a lift in opposite phase. Secondly a hook is provided with four legs, each leg works together with a respective knife. Thirdly for each leg of the hook a means is provided in order to be able to act on the leg of the hook in order to make this bend, such as e.g. an electromagnetic coil. Fourthly a holding catch is provided in order to hold the hook in middle or top position. For that purpose the hook is provided with two notches or holding noses. Fifthly on each short leg a hook is provided. Finally on the hook a nose is provided with which the hook rests in the bottom position on a fixed bottom grid.

According to a preference of the invention the actuators are more specifically electromagnetic and/or piezoelectric actuators.

The characteristics and distinctive features of the invention, and the operation thereof are further explained hereafter with reference to the attached drawings which show four preferred embodiments of the invention. It should be noted that the specific aspects of these embodiments are only described as preferred examples of what is intended in the scope of the above general specification of the invention, and may in no way be interpreted as a restriction on the scope of the invention as such and as expressed in the following claims.

BRIEF DESCRIPTION OF THE DRAWINGS

In these drawings:

FIGS. 6 through 8: are front views of three embodiments of a hook element for a shed-forming device according to FIGS. 1–5;

FIG. 9: is a side view of a variant of the shed-forming device according to FIGS. 1–5;

FIGS. 10 through 15: are side views of a shed-forming device according to the invention, in a specific embodiment for a three-position open-shed jacquard weaving device, shown in different positions of the hook element and of the knives;

FIG. 16: is a front view of a hook element for a shed-forming device according to FIGS. 10–15.

DETAILED DESCRIPTION OF THE PREFERRED EMBODIMENTS

Figure 1:
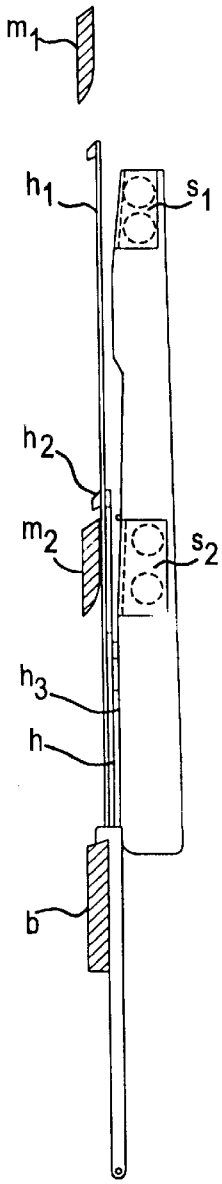
FIGS. 1 through 5: are side views of a shed-forming device according to the invention, in a specific embodiment for a two-position open-shed jacquard weaving device, shown in different positions of the hook element and of the knives.

In FIG. 1 a shed-forming device is shown, according to a first embodiment of the invention destined for a two-position open-shed jacquard device, in a position whereby the hook h rests on the bottom grid b and the two lifting knives $m_1$ and $m_2$ are at their dead point of lifting completely apart from one another. The hook $h_1$ is with its top part in front of the coil $S_1$, the middle hook $h_2$ with top part in front of coil $S_2$. The long hook $h_1$ has a hook on the top with which it can be hooked onto the top knife $m_1$. The middle hook $h_2$ also has a hook with which it can be hooked onto the bottom moving lifting knife $m_2$. Hook $h_2$ works through a hole in hook $h_1$. The short hook $h_3$ has a hole or a window opening with which this hook can be hooked onto the projecting hook on coil $S_2$. See FIG. 6 with view according to arrow X in FIG. 5.

When the hook according to the pattern determined by the jacquard control has to remain down on the following pick, coil $S_2$ will be energized through which hook $h_2$ is bent away from knife $m_2$ so that hook $h_2$ comes out of reach of knife $m_2$. The hook $h_2$ has a hole in order not to be impeded by the projecting hook on $S_2$. Knife $m_2$ moves upward, $m_1$ move downward. Hook h remains standing on bottom grid b. Top knife $m_1$ has to move past on hook $h_1$. For that purpose knife $m_1$ will on the bottom have a suitable form in order to press hook $h_1$ away mechanically. Or at this moment coil $S_1$ can also effectively be energized with a control provided for that purpose through which hook $h_1$ is bent over and is held out of reach of knife $m_1$. The new position of the hook h is represented in FIG. 2.

Figure 4:
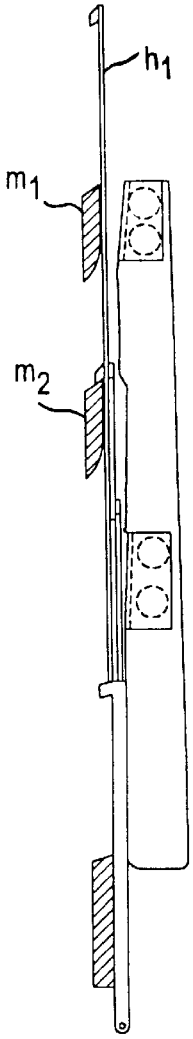

When the hook according to the pattern determined by the jacquard control has to be up on the following pick no coil will be energized through which hook $h_2$ with knife $m_2$ is engaged so that hook $h_2$ comes into the top position as represented in FIG. 4. Knife $m_1$ in its downward movement also comes past hook $h_1$ which is in upward movement. Through the suitable form of knife $m_1$ this can mechanically press the hook $h_1$ away or $S_1$ can at this time be energized by a suitable control.

Figure 2:
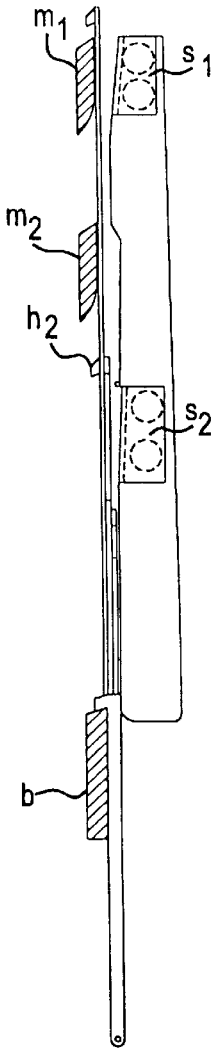

In order to bring a hook from the position as represented in FIG. 2 into the top position, no coil will be energized. Hook $h_1$ is not bent and will therefore move upward with knife $m_1$. With this upward movement hook $h_1$ will have to pass by knife $m_2$. This can likewise occur mechanically through a suitable form of knife $m_2$ or through a suitable energization of coil $S_2$ at this time of crossing. In hook $h_2$ an elongated hole is provided in order to provide passage for the hook of $S_2$ (See FIG. 6). The hook reaches the top position as represented in FIG. 3.

Figure 3:
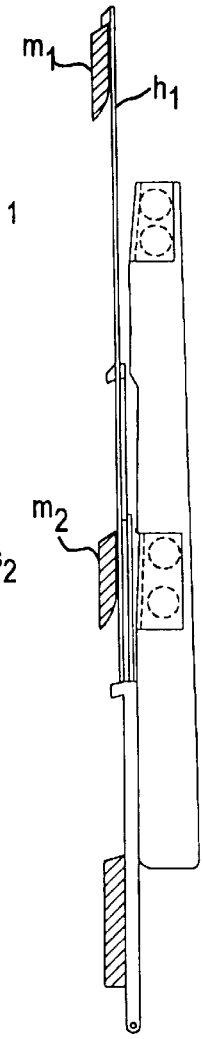

In order to hold the hook up as represented in FIG. 3, coil $S_2$ will be energized. The short hook $h_3$ is with its top part right in front of coil $S_2$ and the window opening of $h_3$ is in front of the projecting hook on coil $S_2$. Because of the bending the hook $h_3$ is hooked onto this projecting hook and the hook will remain up during the downward movement of knife $m_1$. The hook h remains in top position as represented in FIG. 4. In order to hold the hook in the position from FIG. 4 coil $S_2$ will again be energized, otherwise the hook just comes back down with knife $m_2$.

Figure 5:
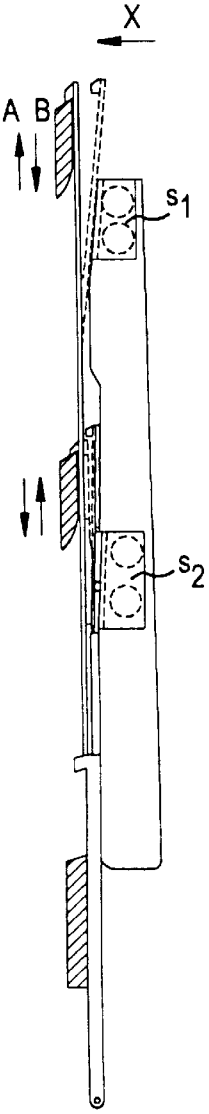

In order to allow the hook in top position as represented in FIG. 3 to move downward into position as represented in FIG. 2, no coil will be energized. With its upward movement knife $m_2$ has to go past the hook $h_2$ and for that purpose coil $S_2$ will be energized at the time of the crossing. This position is illustrated in FIG. 5, direction of movement B and hooks drawn in full lines.

In order to allow the hook from above to move out of the position as represented in FIG. 4 downward into position as represented in FIG. 1, no coil will be energized. With its upward movement knife $m_1$ has to go past the hook $h_1$ and at this time coil $S_1$ will be energized in order to hold hook $h_1$ out of reach of knife $m_1$. This position is illustrated in FIG. 5, direction of movement B and hooks drawn in dotted lines.

From the preceding specification it appears that each hook can be held in its position or can be moved to the other second position. The device according to the invention therefore complies with the open-shed principle. The device according to the invention works without pulley elements. Due to the multilayered hook the footprint occupied is very limited.

Instead of a multilayered hook the hook can also be formed by three flat steel strips situated next to each other in the same plane. See FIG. 7. The long hook $h_1$ and middle hook $h_2$ can also be situated next to each other and the hook $h_3$ can then stand against both. See FIG. 8. With this construction of the hook the projecting hook on coil $S_2$ can work in the path of hook $h_1$ and a hole in hook $h_2$ is no longer necessary.

As shown in FIG. 9, the device can also work with a third actuator or selection element $S_3$ in the form of a rotating catch which is electromagnetically or piezoelectrically controlled in order to hold the hook h in top position. This selection element can e.g. act on hook h which is provided for that purpose with a window opening, a notch or a hook. This can of course be effected with the additional cost of one selection element. The hook can then be limited to two layers $h_1$ and $h_2$, or two hooks situated next to each other in the same plane, whereby each hook $h_1$ and $h_2$ each has a coil $S_1$, respectively $S_2$ in its path.

In FIGS. 10–16 a shed-forming device is shown, according to an embodiment of the invention destined for a three-position open-shed jacquard device. In these figures the hook with four legs is schematically represented for the sake of simplicity with each leg situated in a different plane. The legs can also be situated next to each other two by two in the same plane (see FIG. 16), or all four can be situated next to each other in the same plane. The harness cords are attached at the bottom of the hook and a spring load constantly pulls the hook down. The knives serve to lift the hooks upward or downward against the spring load. This device is also particularly suitable for a harness-free jacquard device with three positions. The jacquard heddles through which the pile warp threads are pulled through, can be directly connected to the hook and the heddle retracting spring can possibly be partially or completely built into the shank of the hook.

In order to implement the three positions firstly four knife systems $m_1$, $m_2$, $m_3$ and $m_4$ are provided which move in one and the same vertical plane. See FIG. 10. The knives $m_1$ and $m_2$ perform a lift 2H in opposite phase: i.e. when $m_1$ is in the bottom dead point, then $m_2$ is in the top dead point. The knives $m_3$ and $m_4$ perform a lift H in opposite phase.

Secondly a hook is provided with four legs, each leg works together with a respective knife $m_1$, see FIG. 16. Thirdly for each leg of the hook a means is provided in order to be able to act on the legs of the hook in order to make this bend. This means is e.g. an electromagnetic coil $S_1$. Fourthly a holding catch k with operating actuator $S_5$ is provided in order to hold the hook in middle or top position. For that purpose the hook is provided with two notches or holding noses situated at a distance equal to (H−2×removal play). Fifthly on each short leg $h_3$ and $h_4$ a second hook $h'_3$ and $h'_4$ is provided at a distance equal to (H−2×removal play). The removal play is the distance between the top of the knife and bottom of the hook on each leg of the hook. A removal play is necessary in order to be able to remove the leg from the knife. Finally a nose is provided on the hook with which the hook in bottom position rests on a fixed bottom grid b.

In the bottom position the hook rests on the fixed bottom grid b. In FIG. 10 this position is represented with the knives $m_1$ and $m_3$ in their bottom dead point and $m_2$ and $m_4$ in top dead point. In FIG. 11 the other position is represented. These positions are repeated cyclically every two picks or weft insertion cycles. In FIGS. 12 and 13 the hook is represented in middle position and in FIGS. 14 and 15 in top position, in each case with the respective positions of the lifting knives. A preferred embodiment of the hook is shown in FIG. 16.

When according to the prescribed pattern the hook has to remain down on a following pick, the coils $S_1$ and $S_3$ will be triggered in order to make the legs $h_1$ respectively $h_3$ bend, so that these cannot be carried by the ascending knives $m_1$ and $m_3$. Instead of coils other means can also be provided for making the legs bend. The catch k is released by coil $S_5$. The knives $m_1$ and $m_3$ move upward, and the knives $m_2$ and $m_4$ downward. At the end of this movement the bottom of the knives $m_2$ and $m_4$ will strike against the top of the legs $h_2$ and $h_4$. In order to prevent this the bottom of the knives will be given a bevelled form, so that the top of the hooks can be mechanically pressed away by the knives. At that time the coils $S_2$ and $S_4$ can also appropriately be triggered in order to make the legs bend, so that these come out of reach of the knives, this will be referred to in what follows as an avoiding action. The hook therefore remains resting on the bottom grid b and remains in bottom position as represented in FIG. 11.

If the hook on the following pick has again to remain down, then coils $S_2$ and $S_4$ will be triggered in order to bend the legs $h_2$ and $h_4$ away from the knives $m_2$ and $m_4$. The catch k is released by coil $S_5$. At the end of their movement the bottom of the knives $m_1$ and $m_3$ will strike against the top of the legs $h_1$ and $h_2$. In order to prevent this the bottom of the knives will be given a bevelled form, so that the top of the hooks can be mechanically pressed away. At that time an avoiding action can appropriately be performed, by triggering the coils $S_1$ and $S_3$ in order to make the legs bend, so that these come out of reach of the knives. The hook therefore remains resting on the bottom grid b and remains in bottom position as represented in FIG. 10.

When a hook according to the prescribed pattern has to move from the bottom position to the middle position this is only possible by changing from the position represented in FIG. 10 to the position in FIG. 13 or from the position represented in FIG. 11 to the position in FIG. 12, in view of the movement sequence of the knives.

In order to bring a hook from the bottom position, situation represented in FIG. 10, into the middle position, represented in FIG. 13, coil $S_1$ will be triggered in order to hold the top of the leg $h_1$ out of reach of knife $m_1$. The catch k is released by coil $S_5$. The hook will be carried with leg $h_3$ by the ascending knife $m_3$ over a lift equal to (H−removal play) to the middle position, where leg $h_3$ remains resting on knife $m_3$. The knives $m_2$ and $m_4$ in their descending movement meet the tops of the ascending hooks $h_2$ and $h_4$. In order to prevent passing strikes the bottom of the knives will be suitably bevelled and an avoiding action will be performed by triggering the coils $S_2$ and $S_4$ at that time. The hook rests with leg $h_3$ on the knife $m_3$, see FIG. 13, and in order to be able to remove leg $h'_4$ from the knife $m_4$, the second hook $h'_4$ on the leg $h_4$ will be placed at a distance from the top hook equal to (H−2×removal play).

In order to bring a hook from the bottom position, situation represented in FIG. 11, into the middle position, situation represented in FIG. 12, coil $S_2$ will be triggered in order to hold the top of the leg $h_2$ out of reach of knife $m_2$. The catch k is released by coil $S_5$. The hook will be carried with leg $h_4$ by the ascending knife $m_4$ over a lift equal to (H−removal play) to the middle position, where leg $h_4$ remains resting on knife $m_4$. The knives $m_1$ and $m_3$ in their descending movement meet the tops of the ascending hooks $h_1$ and $h_3$. In order to prevent a collision the bottom of the knives will be suitably bevelled and an avoiding action will be performed by triggering the coils $S_1$ and $S_3$ at that time. The hook rests with leg $h_4$ on the knife $m_4$, see FIG. 12, and in order to be able to remove leg $h'_3$ from the knife $m_3$, the second hook $h'_3$ on the leg $h_3$ will be placed at a distance from the top hook equal to (H−2×removal play).

The hooks can also be brought from middle position to bottom position. In order to bring a hook from middle position, in FIG. 13, to the bottom position, of FIG. 10, coil $S_4$ will be triggered and the catch will be released by coil $S_5$. The hook $h'_4$ is removed from knife $m_4$, the hook remains resting with the leg $h_3$ on the knife $m_3$ and will move down with this knife. The descending hook will meet the ascending knife $m_2$ with leg $h_2$ and in order to prevent engagement an avoiding action will be performed by triggering coil $S_2$ at that time. The hook on leg $h_4$ also meets knife $m_4$ and in order to prevent engagement an avoiding action will also be performed here by again triggering coil $S_4$ at that time. An avoiding action will be performed by triggering coil $S_1$ in order to make $h_1$ veer away when knife $m_1$ has to pass by that top with its underside. The hook comes into bottom position and rests with its nose on the bottom grid b.

In order to bring the hook from the middle position of FIG. 12 to bottom position of FIG. 11, coil $S_3$ will be triggered and the catch will be released by coil $S_5$. The hook $h'_3$ is removed from knife $m_3$, the hook remains resting with leg $h_4$ on knife $m_4$ and will move downward with this knife. The descending hook will meet the ascending knife $m_1$ with leg $h_1$ and in order to prevent engagement an avoiding action will be performed by triggering coil $S_1$. The hook of the leg $h_3$ also meets knife $m_3$ and in order to prevent engagement an avoiding action will also be performed here by again triggering coil $S_3$. The hook comes into bottom position and rests with its nose on the bottom grid b.

The hook can also remain in the middle position. In order to hold the hook in the middle position, from the position in FIG. 13 to that of FIG. 12, the coil $S_4$ will be triggered, through which the hook $h'_4$ is held out of reach of the knife $m_4$, and the catch k will be made to engage in the top notch of the hook by coil $S_5$. The hook descends with knife $m_3$ until the notch rests on the catch k. The hook remains in the middle position. Knife $m_2$ has to pass by the hook of leg $h_2$ without engaging it, for that purpose a removal action will be performed by triggering coil $S_2$ at that time in order to remove the hook of the leg $h_2$ from the knife $m_2$. The knives $m_1$ and $m_3$ must respectively pass by $h_1$ and $h'_3$, for that purpose an avoiding action will be performed by triggering the coils $S_1$ and $S_3$.

In order to hold the hook from the middle position of FIG. 12 in the middle position in FIG. 12, coil $S_3$ will be triggered, through which the hook $h'_3$ is held out of reach of the knife $m_3$, and the catch k will be made to engage in the top notch of the hook by coil $S_5$. The hook descends with the knife $m_4$ until the notch rests on the catch k. The hook remains in the middle position. Knife $m_1$ has to pass by the hook of leg $h_1$ without engaging it, for that purpose a removal action will be performed by triggering the coil $S_1$ at that time in order to remove $h_1$ from the knife $m_1$. The knives $m_2$ and $m_4$ must respectively pass by $h_2$ and $h'_4$, for that purpose an avoiding action will be performed by triggering the coils $S_2$ and $S_4$.

The top position can be reached from every bottom position. The transitions of the positions represented in FIG. 10 to those of FIG. 15 and those from FIG. 11 to FIG. 14 and vice versa should be demonstrated. In order to go from bottom position, as represented in FIG. 10, to the top position, as represented in FIG. 15, first no coil will be triggered. The catch is released by coil $S_5$. The hook will move with knife $m_1$ over a lift (2H) upward into the top position. The knife $m_2$ has to pass by leg $h_2$, for that purpose an avoiding action will be performed by triggering coil $S_2$ at that time. The hook $h'_3$ has to pass by the knife $m_3$, at that time an avoiding action will be performed by triggering the coil $S_3$. The knife $m_4$ has to pass by $h_4$ and $h'_4$, for that purpose an avoiding action will be performed by triggering coil $S_4$ at that time. The hook rests on knife $m_1$.

In order to go from bottom position, as represented in FIG. 11, to the top position, as represented in FIG. 14, first no coil will be triggered. The catch is released by coil $S_5$. The hook will move with knife $m_2$ over a lift equal to (2H) upward into the top position. The knife $m_1$ has to pass by leg $h_1$, for that purpose an avoiding action will be performed by triggering coil $S_1$ at that time. The knife $m_3$ has to pass by leg $h_3$ and hook $h'_3$, at that time the coil $S_3$ will be triggered in order to perform an avoiding action. The knife $m_4$ has to pass by hook $h'_4$, for that purpose the coil $S_4$ will be triggered at that time in order to perform an avoiding action. The hook now rests on knife $m_2$.

In order to go from top position, as represented in FIG. 15, to the bottom position, as represented in FIG. 10, coil $S_3$ will be triggered, through which the hook $h'_3$ is removed from the knife $m_3$. The catch is released by coil $S_5$. The hook will move with knife $m_1$ over a lift equal to (2H) downward into the bottom position. The knife $m_2$ has to pass by the hook of leg $h_2$ without engaging it, for that purpose a removal action will be performed by triggering coil $S_2$ at that time in order to remove the hook of leg $h_2$ from the knife $m_2$. The hook of leg $h_3$ has to pass by the knife $m_3$, at that time a removal action will also be performed by again triggering the coil $S_3$. The hook $h'_4$ and hook of leg $h_4$ have to pass by the knife $m_4$ without engagement movement, for that purpose a removal action will be performed by triggering the coil $S_4$ at that time. The hook now rests on the bottom grid b.

In order to go from top position, as represented in FIG. 14, to the bottom position, as represented in FIG. 11, coil $S_4$ will be triggered, through which the hook $h'_4$ is removed from the knife $m_4$. The catch is released by coil $S_5$. The hook will move with knife $m_2$ over a lift (2H) downward into the bottom position. The hook of the leg $h_1$ has to pass by knife $m_1$ without engagement, for that purpose a removal action will be performed by triggering coil $S_1$ at that time. The hook of leg $h'_3$ and the hook of leg $h_3$ has to pass by knife $m_3$ without engagement movement, at that time coil $S_3$ will be triggered in order to perform a removal action. The hook now rests on the bottom grid b.

The hook can also remain in the top position. In order to hold the hook in top position through transition from the situations in FIG. 15 to FIG. 14, no coil will be triggered and the catch k is engaged in the bottom notch of the hook by coil $S_5$. The hook will rest on the catch and because of this remains in the top position. In order to hold the hook in top position through transition from FIG. 14 to FIG. 15, no coil will be triggered and the catch k is engaged by coil $S_5$ in the bottom notch of the hook, which will rest on the catch and because of this remains in top position. With both transitions no removal action nor any avoiding action need be performed.

The hook can be brought from the middle position to the top position and vice versa. In order to come from the middle position, as represented in FIG. 12, to the top position, as represented in FIG. 15, no coil will be triggered and the catch k is released by the coil $S_5$. The hook is carried by the knife $m_3$ with the hook $h'_3$ over a lift equal to (H) and at the end of this lift the knife $m_1$ takes up the hook with the hook of the leg $h_1$. The hook rests with the leg $h_1$ on the knife $m_1$ through which between the hook $h'_3$ and the knife $m_3$ again a removal play develops. The top of the ascending hook $h_2$ must avoid the descending knife $m_2$, for that purpose an avoiding action will be performed by triggering coil $S_2$. The hook $h'_4$ must avoid the knife $m_4$, for that purpose an avoiding action will be performed by triggering coil $S_4$.

In order to come from the middle position, as represented in FIG. 13, to the top position, as represented in FIG. 14, no coil will be triggered and the catch k is released by the coil $S_5$. The hook is carried by the knife $m_4$ with hook $h'_4$ over a lift (H) and at the end of this lift the knife $m_2$ takes up the hook with the hook of the leg $h_2$. The hook rests with the leg $h_2$ on the knife $m_2$ through which between the hook $h'_4$ and the knife $m_4$ again a removal play develops. The leg $h_1$ of the ascending hook must veer away for the descending knife $m_1$, for that purpose an avoiding action will be performed by triggering the coil $S_1$ at that time. The hook $h'_3$ of the ascending hook must pass by the descending knife $m_3$, for that purpose an avoiding action will be performed by triggering coil $S_3$.

In order to bring back the hook from the top position, as represented in FIG. 15, to the middle position, as represented in FIG. 12, no coil will be triggered and the catch k is released by the coil $S_5$. The hook moves with the knife $m_1$ downward, the support is transferred by the hook $h'_3$ to the knife $m_3$ through which the hook will perform a descent (H) with the knife $m_3$. The hook of the leg $h_2$ may not be engaged by the knife $m_2$, for that purpose a removal action will be performed by triggering the coil $S_2$ at that time. The hook $h'_4$ may not be engaged by the knife $m_4$, for that purpose a removal action will be performed by triggering the coil $S_4$ at that time. The hook of the leg $h_4$ will finally hook onto the knife $m_4$ through which again the removal play between the hook $h'_3$ and the knife $m_3$ develops.

In order to bring back the hook from the top position, as represented in FIG. 14, to the middle position, as represented in FIG. 13, no coil will be triggered and the catch k is released by the coil $S_5$. The hook moves with the knife $m_2$ downward, the support is transferred by the hook $h'_4$ to the knife $m_4$ through which the hook will perform a descent equal to (H) with the knife $m_4$. The hook of the leg $h_1$ may not be engaged by the knife $m_1$, for that purpose a removal action will be performed by triggering the coil $S_1$ at that time. The hook $h'_3$ may not be engaged by knife $m_3$, for that purpose a removal action will be performed by triggering the coil $S_3$ at that time. The hook of the leg $h_3$ will finally hook onto the knife $m_3$ through which again the removal play between the hook $h'_4$ and the knife $m_4$ develops.

From the preceding specification it appears that each hook can be held in its position or can be moved to both other positions. The device therefore complies with the open-shed principle and this in fact for the three positions. The device works without pulley cords or any pulley.

What is claimed is:

1. Shed-forming device for individually controlling warp threads of a weaving device comprising heddles for warp threads, hook elements connected to the heddles for the warp threads, upward and downward moving knives for receiving the hook elements, spring elements on the hook elements, actuators for controlling movement of the spring elements and allowing the hook elements to selectively hook or not hook onto the upward and downward moving knives, each hook element having at least three spring elements formed as spring legs, at least two spring elements formed as double laminated springs, at least two of the spring legs having hooks for working together with the moving knives, at least one actuator for selectively controlling the spring elements, and a retaining hook for retaining the hook element when one or more spring elements controlled by the actuator prevents the hook element from not hooking onto the upward and downward moving knives.

2. The device of claim 1, wherein each hook element has at least three spring legs of different lengths, at least longer legs of a hook working together with at least two knives being along one side of the hook element, moving in opposite phase, and wherein each hook element comprises at least one actuator in order to influence one or more spring legs in a high position of the hook element, and at least a further actuator for influencing one or more spring legs in a low position of the hook element, and wherein the retaining hook retains the hook element when the actuators so influence the spring legs that the hooks on those spring legs do not hook onto the upward and downward moving knives.

3. The device of claim 1, wherein each hook element has three spring legs of different lengths formed as a triple spring element, the two longer legs of a hook working together with two knives being provides along one side of the hook element, moving in opposite phase, wherein each hook element comprises one actuator for influencing at least one of the spring legs in a high position of the hook element and a second actuator for influencing one or more spring legs in a low position of the hook element, and wherein the retaining hook is provided on or nearby the second actuator for retaining a shortest of the spring legs in a position determined by the actuator.

4. The device of claim 1, wherein each hook element has three spring legs of different lengths formed as a triple spring element, the two longer legs of a hook working together with two knives being provided along one side of the hook element, moving in opposite phase, wherein each hook element comprises one actuator to influence at least one of the spring legs in a high position of the hook element and a second actuator for influencing one or more spring legs in a low position of the hook element, and wherein the retaining hook influenceable by a third actuator retains the hook element in the high position.

5. The device of claim 1, wherein the three spring elements has a formation selected from a group consisting of a triple laminated spring element, a triple split spring element, and a double laminated, partially split spring element.

6. The device of claim 1, wherein each hook element has four spring legs of different lengths formed as a double laminated, double spring element, each of two longer legs being provided with one hook working together with two top knives along one side of the hook element, moving in opposite phase, and wherein each of two shorter legs is provided with two hooks destined to work together at different heights with two bottom knives along one side of the hook element, moving in opposite phase, wherein each hook element comprises at least five actuators for influencing the spring legs in different positions of the hook element, and a locking mechanism is provided for retaining the hook element when the actuators so influence the spring legs that the hooks on the spring legs do not hook onto the upward and downward moving knives.

7. The device of claim 1, wherein a locking mechanism comprises the retaining hook and a further actuator for influencing the retaining hook, wherein the locking mechanism retains the hook element at selected heights when one or more of the other actuators so influence the spring legs that the hooks on the corresponding spring legs do not hook onto the upward and downward moving knives.

8. The device of claim 7, wherein the locking mechanism retains the hook element in a top position and in a middle position.

9. The device of claim 1, wherein the actuators are electromagnetic and piezoelectric actuators.

10. The device of claim 1, wherein the actuators are electromagnetic actuators.

11. The device of claim 1, wherein the actuators are piezoelectric actuators.

* * * * *